United States Patent [19]

Niedermeyer

[11] 4,228,428

[45] Oct. 14, 1980

[54] VISIBLE SIGNAL FOR ALARM, SUCH AS A SMOKE DETECTOR

[76] Inventor: Karl O. Niedermeyer, 17W068 North St., Bensenville, Ill. 60106

[21] Appl. No.: 26,336

[22] Filed: Apr. 2, 1979

[51] Int. Cl.[3] ..... G08B 17/10; G08B 00/00

[52] U.S. Cl. ..... 340/628; 73/431; 116/200; 248/318; 248/544; 292/17; 340/371; 340/373; 340/376; 340/693

[58] Field of Search ..... 340/628, 629, 630, 376, 340/568, 585, 693, 373, 366 A, 366 R; 116/216, 217, 215, 218, 106, 200, 101, 100, 203, 204; 222/39; 248/345, 544, 550; 362/255; 220/326, 375; 292/17; 248/318

[56] References Cited

U.S. PATENT DOCUMENTS

| | | | |
|---|---|---|---|
| 1,909,124 | 5/1933 | Rogers | 362/255 |
| 3,168,988 | 2/1965 | Kula | 362/255 |
| 3,785,334 | 1/1974 | Waldeck | 116/106 |
| 3,959,787 | 5/1976 | Messmann et al. | 340/585 |
| 4,022,148 | 5/1977 | Chapman | 222/39 X |
| 4,040,381 | 8/1977 | Keogh, Sr. et al. | 116/200 X |

FOREIGN PATENT DOCUMENTS

| | | | |
|---|---|---|---|
| 362745 | 4/1906 | France | 116/101 |

*Primary Examiner*—John W. Caldwell, Sr.
*Assistant Examiner*—Daniel Myer
*Attorney, Agent, or Firm*—Darbo & Vandenburgh

[57] ABSTRACT

The cover of a ceiling mounted smoke detector is hung at one side by a chain from the detector frame. At the other side the cover has a clip which engages the smoke detector battery. Thus if the battery is not in place the cover hangs down from the chain providing a signal indicative of the absence of the battery. A flag is provided which is pivotally mounted inside the cover and movable on the pivot through an opening in the bottom of the cover. A magnet attached to the flag magnetically engages the diaphragm of the horn alarm in the smoke detector and maintains the flag at a raised position within the cover. When the horn alarm is sounded, the vibration of the diaphragm causes disengagement of the magnet whereupon the flag pivots downwardly to a position at which it extends below the cover. This provides a visual indication that the horn alarm has been sounded.

5 Claims, 3 Drawing Figures

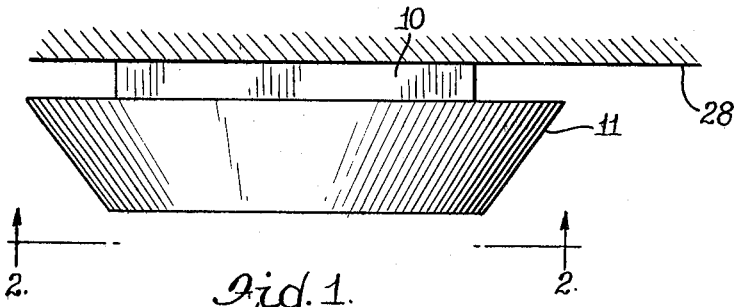
Fig. 1.
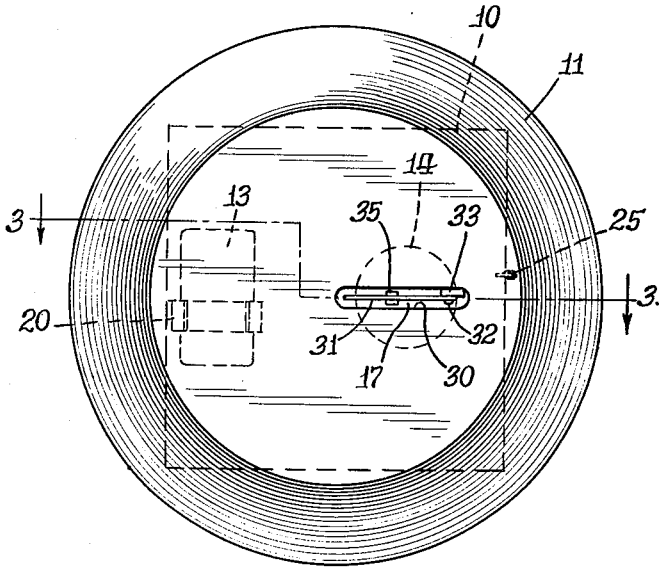
Fig. 2.
Fig. 3.
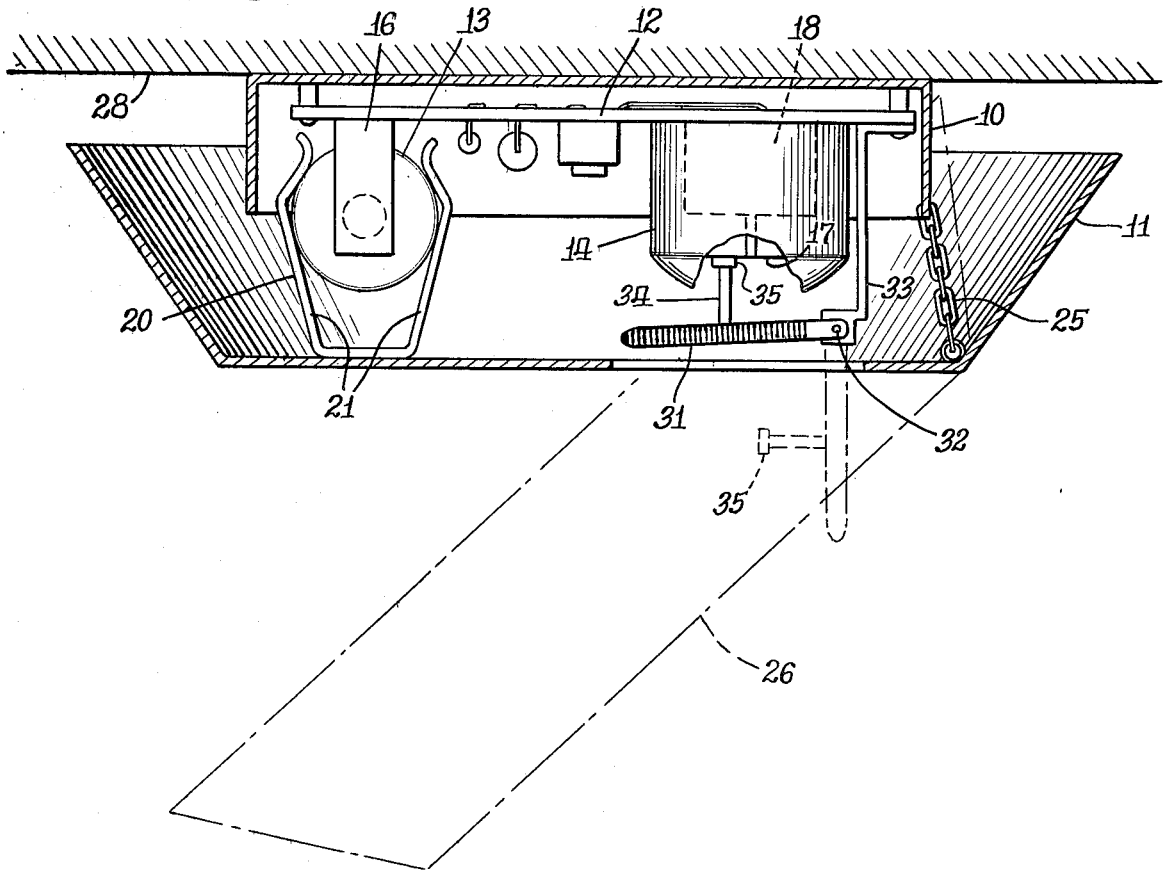

VISIBLE SIGNAL FOR ALARM, SUCH AS A SMOKE DETECTOR

BACKGROUND AND SUMMARY OF THE INVENTION

Various battery energized alarm systems are vulnerable to an unrecognized absence of battery power. Of course, in the absence of the battery power the alarm system is useless. At least one major city has an ordinance requiring the presence of smoke detectors in hallways of apartment buildings within particular classifications. In many instances these smoke detectors, although present as required by the ordinance, are inoperable because vandals have removed the batteries to use to power their radios, etc. Since the battery is mounted within the cover of the smoke detector its absence is not readily observable. Consequently, the tenants and operators of apartment buildings suffer from a false sense of security by the physical presence of the smoke detector under such circumstances.

Another situation that will occasion a similar false sense of security is where the battery has supplied power during the operation of the smoke detector to an extent such that it is depleted. For example, while a home owner is away from home a limited amount of smoke may occur, sufficient to set off the smoke detector, but the cause of the smoke not being sufficiently significant to alarm the home owner upon return. The smoke detector having been set off would continue to sound its horn until the battery is depleted. Since no one was present to hear the horn, upon the home owner's return there is no awareness that the battery has been depleted. This, of course, may occur with other types of battery operated alarm systems, as for example a sump pump alarm, etc.

The present invention is a visible alarm apparatus which will apprise an observer of the fact of occurrences such as those described above, which occurrences have resulted in the lack of battery power to the alarm device. One facet of the invention is the attaching of the cover of the alarm device to the battery by a clip so that in the absence of the battery, the cover will not remain in its normal location. Another facet of the invention is the use of a signal flag which is held in a concealed, or retracted, position by magnetic engagement with the diaphragm of the alarm horn. The sounding of the horn breaks that magnetic engagement and permits the signal flag to move to an exposed, or displaced, position thus signifying to an observer that the alarm has sounded even though the alarm is now silent as a result of the depletion of the battery power.

DESCRIPTION OF THE DRAWINGS

FIG. 1 is an elevational view of a ceiling mounted smoke detector embodying the invention;

FIG. 2 is a bottom view of the detector of FIG. 1 as seen at line 2—2 of FIG. 1; and FIG. 3 is a section as seen at line 3—3 of FIG. 2.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

The illustrated smoke detector (alarm device) comprises a frame 10 and a cover 11. Frame 10 is in the form of a box open at one side, that one side being the bottom in the embodiment as illustrated. Within the frame 10 is a circuit board 12 which holds the various alarm components. These alarm components include a battery 13 and a horn 14. The battery is releasably engaged to a pair of electrical conductive mounting straps 16, one at each end of the battery. Thus the battery may be removed to be replaced as required. The horn 14 includes a ferromagnetic diaphragm 17 which is vibrated by a transducer 18 to produce an audible signal. Also among the components mounted on the circuit board is one (or more) of several available types of sensors activated by heat or smoke to result in the energizing of the transducer 18 from battery 13. As thus far described, the alarm device is conventional.

In the prior art, various means have been employed to releasably affix the cover 11 in front of the open side of the frame 10, i.e., in the position illustrated in FIG. 1. In the present invention the mounting of the cover on the frame is accomplished at least in part by means which engages the battery 13. Thus in the absence of the battery, the cover will not stay in its normal position. In the illustrated embodiment there is a clip 20 which is secured (as by means of spot welding, etc.) to the inside of cover 11. This clip has two arms 21 each of which engages about a respective side of the battery. The distal ends of the arms are curved outwardly to facilitate slipping the clip about the battery. Preferably each arm fits about an arc of a side of the battery, the sides being diametrically opposed, so as to normally hold the cover against displacement either toward or away from frame 10, unless sufficient force is applied to actually produce disengagement of the clip from the battery.

The opposite side of the cover is held to the frame by a hinge means. In the illustrated embodiment this hinge means takes the form of a chain 25 connecting the frame and the cover. The exact location of the chain, and the number of links (which may be as few as one) will depend upon the relative configuration of the cover and frame and their spatial relationship. Of course, such configurations and relationships vary with different manufacturers.

In the event that the clip 20 is disengaged from the battery 13, or in the event that the battery is not present, the cover will hang down from the chain much in the manner illustrated by dot-dash lines 26 with the cover thus serving the function of a signal flag. An observer seeing the difference of the signal flag in this position and that illustrated in FIG. 1, would be apprised that further investigation is in order to determine the reason for the change in position of the cover. That reason could be, of course, that the battery 13 had been removed rendering the alarm device inoperable.

In the illustrated embodiment the smoke detector is shown as mounted on an upper horizontal surface 28, such as a ceiling. In the event that it were to be mounted on a vertical surface, instructions would be supplied to position the battery side of the frame upwardly, with the hinge side of the cover support being downwardly. Thus with the battery not in place, the cover will be displaced away from the frame by gravity. This would not necessarily occur were the hinge side positioned upwardly.

In the area in front of the horn 14, the cover has an opening 30. Immediately behind this opening is a signal flag 31. This signal flag has a proximal end which is connected by a pivot pin 32 to a fixed support 33. Intermediate the proximal and distal ends of the flag is a finger 34 which extends within the casing of the horn. A small magnet 35 on the end of the finger magnetically engages the diaphragm 17. In the event that the diaphragm 17 is vibrated in the course of producing an audible signal, this magnetic engagement is broken thus permitting the signal flag to pivot under the influence of gravity down to the position illustrated in dashed lines in FIG. 3. As suggested by the vertical lines on the signal flag, it may be colored red or another conspicuous color to better call attention to it. I have used as a magnet a one-quarter inch (0.635 c.m.) square piece of the magnetic material sold for the magnetic affixion of signs and the like, i.e., a plastic flexible magnetic strip having a ferrous magnetic powder that forms the magnet. Such material has a pressure sensitive adhesive on one side and its magnetic strength is such that one square inch (6.45 sq. c.m.) has a twelve ounce (0.3402 k. gm.) pull. This has proven entirely suitable to suspend a small signal flag as illustrated from the diaphragm of the typical small horns employed in smoke detectors, yet insufficient to maintain the magnetic engagement to the diaphragm while the diaphragm is being vibrated. The maximum and minimum strength required for a magnet will vary with the conditions, as for example the size and weight of the signal flag, the violence of the diaphragm vibration, etc. This can be readily determined empirically.

The pivotal connection of the signal flag should be on what will be the low side of the alarm device in the event that the alarm device is mounted on a wall. Thus gravity can still be employed to swing the signal flag about its pivot to an exposed position. Also, positioning of the distal end of the flag somewhat farther away from frame 10 than is the proximal end (as illustrated) will ensure that with a wall mounting gravity will produce the desired pivotal movement.

Of course, either of the visual signaling means described herein may be employed without the presence of the other. For example, the signal flag 31, etc., employed in conjunction with the horn 14 to provide a visual indication that the horn has been sounded could be used in conjunction with a sump pump alarm (by way of illustration of a sump pump alarm see U.S. Pat. No. 3,999,890). However, their use together in a smoke alarm, etc., provides protection against two quite different conditions that can result in the unavailability of electrical power.

I claim:

1. A visible signal apparatus for an alarm device such as a smoke detector or the like, which alarm device is powered by a battery member and includes a horn with a diaphragm member which is vibrated to produce an audible alarm signal and a frame, said apparatus being characterized by:

a signal flag hingedly connected to said frame, said flag having a distal terminus spaced from the hinge connection to the frame, said flag being movable by gravity about said hinge connection between an upper position in juxtaposition to said member and a lower position away from said member; and means secured to the flag, spaced from the hinge connection and releasably engaging one of said members and holding said flag in said upper position whereby when said engagement does not exist said flag will move to said lower position.

2. An apparatus as set forth in claim 1, wherein said battery member is removably mounted on said frame and is exposed below said frame and wherein said device includes a cover having a normal mounted position in juxtaposition to the frame and connected to the frame in a manner such that it may be moved away from the frame sufficiently to permit the battery member to be removed and replaced, said apparatus being further characterized by:

said cover forming said signal flag and said upper position being the normal mounted position of the cover; and said means including a clip secured to the cover and engaging about said battery member to support said cover in conjunction with said hinge connection;

whereby when said battery is not in place in said frame to be engaged by said clip said cover cannot be supported in the upper position.

3. An apparatus as set forth in claim 1, wherein said diaphragm member is formed of a ferromagnetic material, said apparatus being further characterized by:

said means including a magnet magnetically engaging said diaphragm member whereby when said horn is sounded the vibration of the diaphragm occurring in the course of producing said alarm signal causes said magnet to become disengaged allowing said flag to move to said lower position.

4. A visible signal apparatus for an alarm device such as a smoke detector or the like which includes a frame, a cover, means releasably supporting the cover from the frame, and a removable battery mounted in an exposed position on the frame and supplying electrical power for the signal apparatus, said apparatus being characterized by said means comprising:

means secured to the cover and releasably engaging said battery and providing sufficient of the support of the cover that the cover will not remain in place in the absence of that releasable engagement, whereby if said battery is absent said cover will not remain so supported thereby providing a visible indication of the absence of the battery.

5. A visible signal apparatus for an alarm device which includes a horn with a diaphragm member which is vibrated to produce an audible alarm signal, said apparatus being characterized by:

a signal flag hingedly connected to said frame, said flag having a distal terminus spaced from the hinge connection to the frame, said flag being movable by gravity about said hinge connection between an upper position in juxtaposition to said member and a lower position away from said member; and means secured to the flag, spaced from the hinge connection and releasably engaging one of said members and holding said flag in said upper position whereby when said engagement does not exist said flag will move to said lower position, said means including a magnet magnetically engaging said diaphragm member whereby when said horn is sounded the vibration of the diaphragm occurring in the course of producing said alarm signal causes said magnet to become disengaged allowing said flag to move to said lower position.

* * * * *